US007581728B2

(12) United States Patent
Yamashita et al.

(10) Patent No.: US 7,581,728 B2
(45) Date of Patent: Sep. 1, 2009

(54) PAPER FEEDER FOR IMAGE FORMING DEVICE, IMAGE FORMING DEVICE, STORAGE MEDIUM FOR PAPER FEEDER CONTROL PROGRAM, AND PAPER FEEDER CONTROL METHOD

(75) Inventors: Hiroshi Yamashita, Osaka (JP); Takayuki Nakahama, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 358 days.

(21) Appl. No.: 11/306,297

(22) Filed: Dec. 22, 2005

(65) Prior Publication Data

US 2006/0197277 A1 Sep. 7, 2006

(30) Foreign Application Priority Data

Dec. 22, 2004 (JP) ..... 2004-370939

(51) Int. Cl.
*B65H 1/08* (2006.01)

(52) U.S. Cl. ..... 271/127; 271/126; 271/153

(58) Field of Classification Search ..... 271/226, 271/152, 157, 110, 126
See application file for complete search history.

(56) References Cited

U.S. PATENT DOCUMENTS

| | | | | |
|---|---|---|---|---|
| 5,419,542 | A * | 5/1995 | Yamada et al. | 271/3.02 |
| 5,647,584 | A * | 7/1997 | Beaudreau et al. | 271/122 |
| 5,678,814 | A * | 10/1997 | Yokoyama et al. | 271/9.05 |
| 5,716,046 | A * | 2/1998 | Katamoto et al. | 271/3.08 |
| 5,887,866 | A * | 3/1999 | Yamauchi et al. | 271/116 |
| 6,824,133 | B2 * | 11/2004 | Richtsmeier | 271/153 |
| 6,869,241 | B2 * | 3/2005 | Ouchi et al. | 400/578 |
| 6,988,723 | B2 * | 1/2006 | Kitami et al. | 271/127 |
| 7,364,155 | B2 * | 4/2008 | Nagao et al. | 271/186 |
| 2003/0085506 | A1 * | 5/2003 | Kubo | 271/117 |
| 2005/0023743 | A1 * | 2/2005 | Fujii et al. | 271/3.14 |
| 2005/0040588 | A1 * | 2/2005 | Chang | 271/126 |
| 2005/0087921 | A1 * | 4/2005 | Aoki et al. | 271/126 |
| 2005/0236760 | A1 * | 10/2005 | Kang | 271/152 |

FOREIGN PATENT DOCUMENTS

| | | | |
|---|---|---|---|
| CN | 1317411 | A | 10/2001 |
| JP | 02066028 | * | 3/1990 |
| JP | 03143833 | * | 6/1991 |
| JP | 5/24680 | A | 2/1993 |
| JP | H05-077944 | A | 3/1993 |
| JP | 05262435 | * | 10/1993 |
| JP | H09-086702 | A | 3/1997 |
| JP | 2000-177852 | A | 6/2000 |
| JP | 2003-327337 | A | 11/2003 |

* cited by examiner

*Primary Examiner*—Patrick H Mackey
*Assistant Examiner*—Patrick D Cicchino
(74) *Attorney, Agent, or Firm*—Global IP Counselors, LLP

(57) ABSTRACT

A paper feeder of a printer 1 includes a manual feed tray 21, a paper feeder roller 23, and a flapper drive unit 25. The manual feed tray 21 has a flapper 33 which can move up and down in the paper stacking direction. The paper feeder roller 23 is located above the manual feed tray 21, and is able to feed the paper on the flapper 33. The flapper drive unit 25 can move the flapper 33 up and down in the paper stacking direction to contact the paper feeder roller 23 through the paper, and moves the flapper 33 up and down at least from the moment that the paper is placed in the manual feed tray 21 until the paper is fed by the paper feeder roller 23.

9 Claims, 5 Drawing Sheets

PAPER FEEDER FOR IMAGE FORMING DEVICE, IMAGE FORMING DEVICE, STORAGE MEDIUM FOR PAPER FEEDER CONTROL PROGRAM, AND PAPER FEEDER CONTROL METHOD

BACKGROUND OF THE INVENTION

1. Field of the Invention

The present invention relates to a paper feeder for an image forming device, an image forming device, a storage medium for a paper feeder control program, and a paper feeder control method.

2. Background Information

Image forming devices such as copiers and printers or the like are commonly known which for instance have a flapper which can move up and down in the paper stacking direction in a manual feed tray. In these types of devices, a space between the flapper and a paper feeder roller positioned thereabove is formed by lowering the flapper, so documents with many pages can easily be set.

Conventional image forming device are also known which, if a misfeed occurs where paper is not detected by a sensor when paper is fed from either the manual feed tray or a paper feeder cassette, the paper feeder rotation drive will be momentarily stopped and then started again, or the rotation speed of the paper feeder roller will be changed, as a retry control in another attempt to feed paper.

Furthermore, with this technology, if misfeeding continues to occur even though retry control has been performed more than a predetermined number of times, a paper jam will be determined to have occurred.

Related technology has already been proposed as shown in Japanese Laid Open Patent Application No. H05-24680.

However, even with this type of retry control, the paper feeder roller may slip and cause a paper jam when the paper is fed again even if the paper feeder roller is stopped or the speed is changed or the like, and thus at times sufficient results are not obtained.

SUMMARY OF THE INVENTION

An object of the present invention is to suppress misfeeds while feeding paper in an image forming device and to improve paper feeding performance.

A paper feeder according to a first aspect of the present invention comprises a paper placing unit, a paper feeder roller, and a flapper drive unit. The paper placing unit has a flapper which can contact paper from the bottom and can move up and down in the paper stacking direction. The paper feeder roller is located above the paper placing unit and can feed the paper on the flapper. The flapper drive unit can move the flapper up and down in the paper stacking direction, and moves the flapper up and down in the paper stacking direction at least from the moment paper is placed on the paper placing unit until paper is fed by the paper feeder roller.

With this device, when paper is placed on the paper placing unit the flapper will move up and down at least one time prior to feeding paper so that the paper will flow smoothly on the flapper, and therefore paper feeding performance will be improved and the occurrence of paper jams can be reduced.

Incidentally, with the present invention, phrases implying up and down directions refer to the direction standard for an image forming device in the normal condition of use, and also includes approximately up and down directions.

Furthermore, the up and down movement of the flapper may be performed at least one time and may also be performed a plurality of times from the moment paper is set in the paper placing unit until paper is fed. Furthermore, as will be described later, the up and down movement of the flapper also includes actions where one end of the flapper moves by rotating a predetermined angle around a pivot. Furthermore, the up and down movement of the flapper may also be performed when paper is placed in the paper placing unit.

Furthermore, the paper placing unit includes paper feeder cassettes and automatic document feeders (hereinafter ADF) in addition to manual feeder trays. Furthermore, paper herein refers not only to blank white paper but also to documents on which some type of image information has already been recorded, and also includes sheet like recording media such as OHP sheets, in addition to regular paper or the like.

A paper feeder according to a second aspect of the present invention is the device according to the first aspect, further comprising an instructing unit for providing instructions on feeding paper to the paper feeder roller. Furthermore, the flapper drive unit moves the flapper up and down at least from the moment instructions are provided by the instructing unit until paper is fed.

With this device, the paper can be more smoothly fed if the flapper is made to move up and down immediately before the paper is fed.

Incidentally, the paper feed instructions are not restricted only to instructions to feed paper, but may also includes instructions which include printing. Furthermore, the paper feed instructions may also include instructions for receiving external image data such as print data or facsimile reception data.

A paper feeder according to a third aspect of the present invention is the device according to the first aspect, further comprising detecting means and a roller drive unit. The detecting means is located downstream from the paper placing unit and can detect paper which has been fed from the paper placing unit. The roller drive unit rotationally drives the paper feeder roller and if paper is not detected by the detecting means within a predetermined period of time from the moment instructions are given to feed paper, and performs retry control on the paper feeder roller. Furthermore, the flapper drive unit moves the flapper up and down at least from the moment instructions are provided from the instructing unit until just prior to retry control is performed by the roller drive unit.

With this device, the retry control will effectively function because the paper is fed smoothly because the flapper is moved prior to the retry control.

A paper feeder according to a fourth aspect of the present invention is the device according to the third aspect, further comprising notifying means for notifying the fact that a paper jam has occurred if paper is not detected by the detecting means even though retry control has been performed by the roller drive unit a predetermined number of times.

With this device, a paper jam is detected and the user is notified if transport of paper is not detected even though the flapper has a move up and down and then retry control has been performed a predetermined number of times.

Incidentally, the form of notification of may be by display of a message that a paper jam has occurred, for instance, or by generating an audible message which provides notification of such.

An image forming device according to a fifth aspect of the present invention comprises a paper feeder and an image forming unit. The paper feeder is the device according to the first aspect. The image forming unit forms an image on paper fed from the paper feeder.

With this device, when paper is placed on the paper placing unit, the flapper will move up and down at least one time prior to feeding paper, so the paper on the flapper will move smoothly, and therefore paper feeding performance can be improved and the occurrence of paper jams can be reduced.

A storage medium according to a sixth aspect of the present invention stores a paper feeder control program executed by a paper feeder which comprising a paper placing unit with a flapper which can contact paper from the bottom and can move up and down in the paper stacking direction, a paper feeder roller positioned above the paper placing unit which can feed the paper on the flapper, and a flapper drive unit which can move the flapper up and down in the paper stacking direction, wherein the paper feeder control program comprises one or more software elements which execute a first step and a second step. In the first step, the flapper is moved up and down by the flapper drive unit in the paper placing unit where paper is placed. In the second step, the paper is fed by the paper feeder roller after the first step.

A control method according to a seventh aspect of the present invention is for a paper feeder having a paper placing unit with a flapper which can contact paper from the bottom and which can move up and down in the paper stacking direction, a paper feeder roller positioned above the paper placing unit which can feed the paper on the flapper, and a flapper drive unit which can move the flapper up and down in the paper stacking direction, and comprising a first step and a second step. In the first step, the flapper is moved up and down by the flapper drive unit in the paper placing unit where paper is placed. In the second step, the paper is fed by the paper feeder roller after the first step.

With the present invention, when paper is placed on the paper placing unit, the flapper moves up and down at least one time prior to the paper being fed, so the paper on the flapper will move smoothly, and therefore paper feeding performance can be improved, and the occurrence of paper jams can be reduced.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Construction of Image Forming Device

Figure 1:
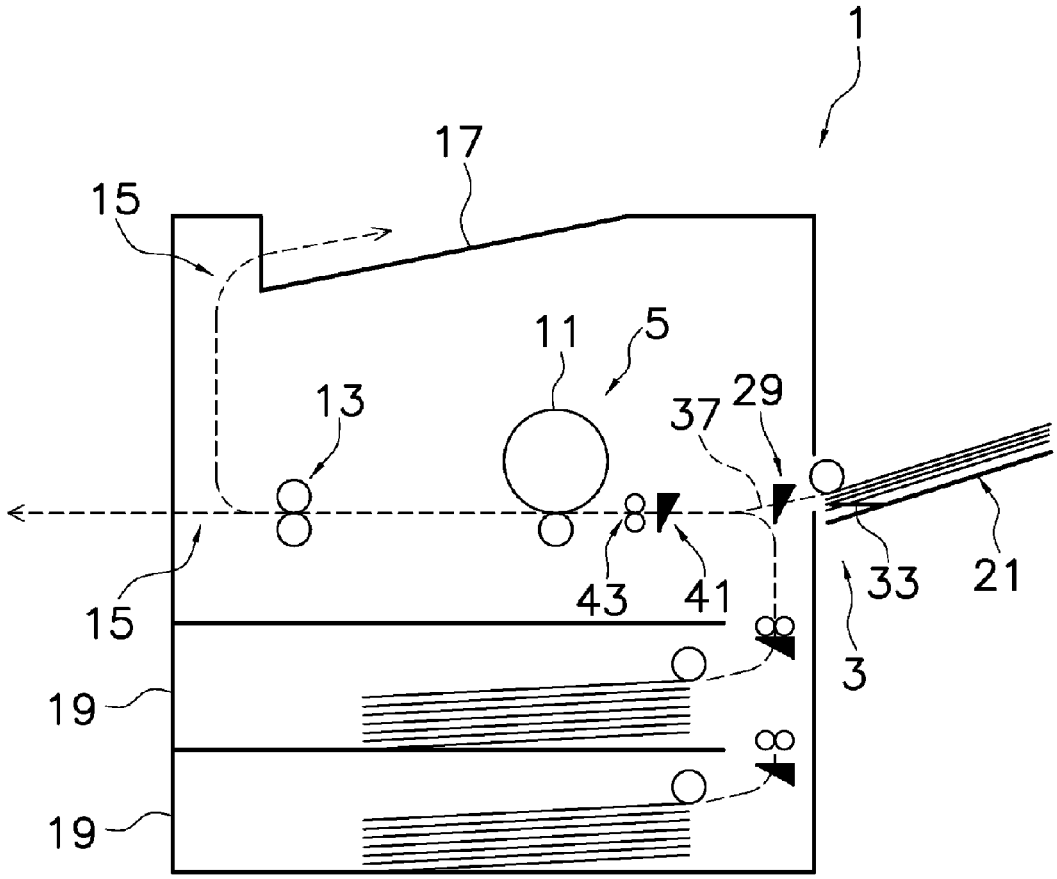
FIG. 1 is a diagram showing an image forming device which uses an embodiment of the present invention.
Figure 2:
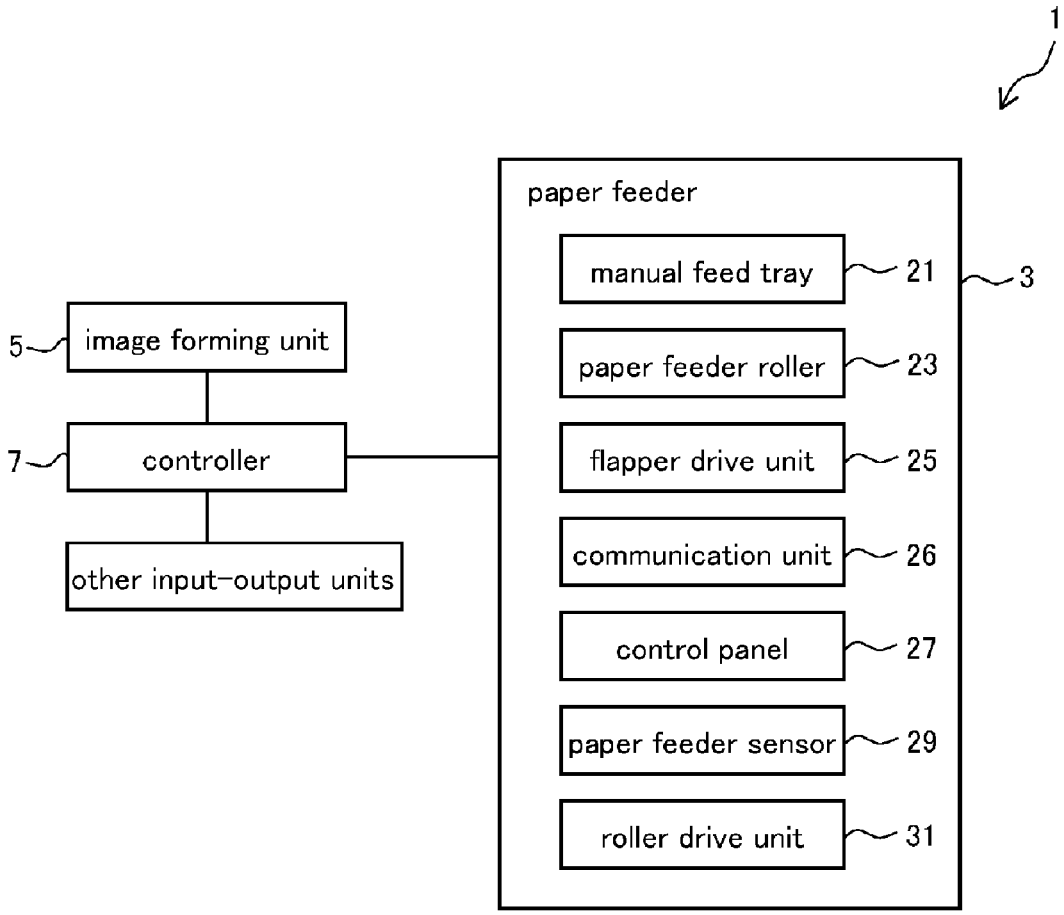
FIG. 2 is a block diagram showing the construction of the image forming device.

A color printer is shown in FIG. 1 and FIG. 2 as an image forming device which uses an embodiment of the present invention.

A printer comprises a paper feeder 3, an image forming unit 5, a control unit 7, and other input-output units.

The image forming unit 5 is for forming an image on paper fed from the paper feeder 3 or a paper feeder cassette 19, and has a photosensitive drum 11, developing devices for each of the toner colors, cyan, magenta, and yellow, located in close proximity, and a toner cartridge (all not shown in the figures), and a fixing device 13 located downstream thereof. Incidentally, a resist sensor 41 and a resist roller 43 are located upstream from the image forming unit 5.

The control unit 7 performs image processing and controls the operation of the input-output units such as the image forming unit 5, and comprises a microcomputer which includes CPU and memory. Various programs for running the CPU are stored in the memory.

The printer 1 has a paper discharge unit 15 or the like as another input-output unit. The paper discharge unit 15 is for externally discharging paper which has passed through the fixing device 13, and selectively discharges paper to the paper discharge tray 17 on top of the printer 1 or to an optional paper discharge tray (not shown in the figures) attached to the side of the printer 1 (left side in FIG. 1).

Paper Feeder

The paper feeder 3 comprises a manual feed tray 21 (paper placing unit), a paper feeder roller 23, a flapper drive unit 25, a communication unit 26 (instructing unit), a control panel 27, a paper feeder sensor 29 (detecting means), and a roller drive unit 31.

The manual feed tray 21 is a plate shaped part which can freely open and close protruding outward from the side (right side in FIG. 1) of the printer 1, and multiple sheets of paper can be placed thereon when in the open condition shown in FIG. 1. Furthermore, the manual feed tray 21 has a flapper 33 which can move up and down in the direction that the placed paper is stacked, at the end on the downstream side in the paper transport direction.

The upstream end of the flapper 33 is rotatably attached to the main body of the manual feed tray 21, and is able to contact the paper from the bottom. The flapper 33 moves to the top position as shown in FIG. 4 when in a free state because of a bias force applied by a coil spring which will be discussed later.

The paper feeder roller 23 is for transporting paper placed on the manual feed tray to the image forming unit 5, one sheet at a time, and is located above the downstream end of the manual feed tray 21. The paper feeder roller 23 is constructed to be able to move slightly upward by being pressed from the bottom by the flapper 33 through the paper.

Figure 3:
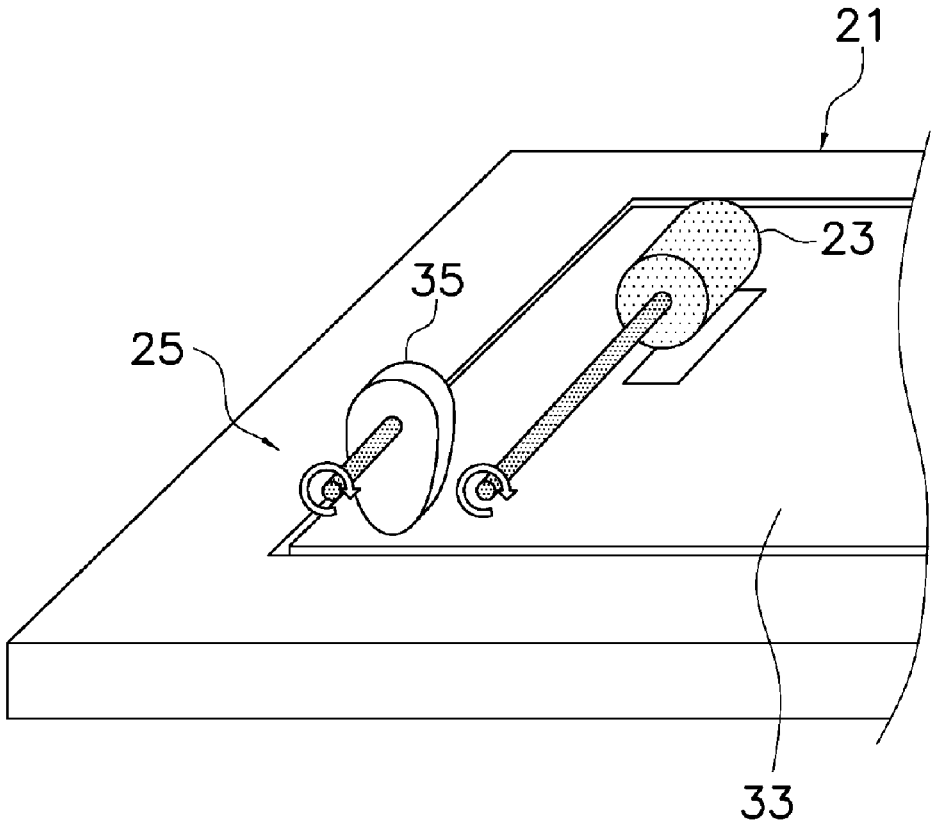
FIG. 3 is a perspective view diagram showing the appearance of a paper feeder of the image forming device.
Figure 4:
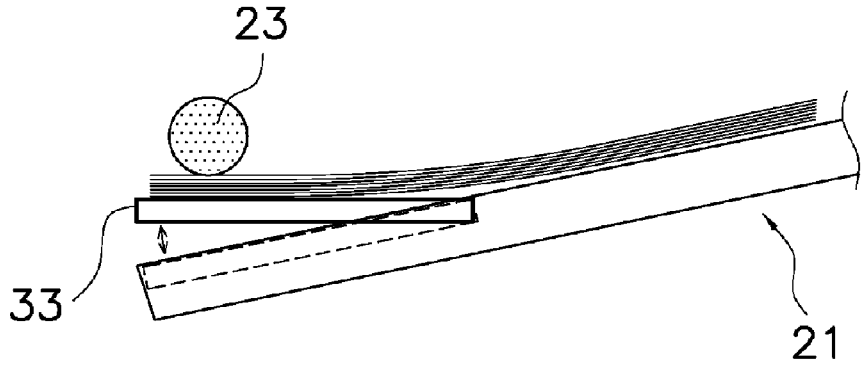
FIG. 4 is a longitudinal cross section diagram showing the major components of the paper feeder.

The flapper drive unit 25 is for moving the flapper 33 up and down in the paper stacking direction, and has an eccentric cam 35 as shown in FIG. 3 and FIG. 4, a cam drive unit (not shown in the figures), and a coil spring (not shown in the figures).

The eccentric cam 35 is supported on each end at both sides in the paper lateral direction of the bottom edge of the main body of the manual feed tray, and the coil spring is mounted on the bottom surface of the flapper 33 so as to apply a bias force which pushes up on the flapper 33 from the bottom. Thereby the flapper 33 will be in a state of contacting the eccentric cam 35 from the bottom, and each time the eccentric cam 35 makes a rotation, the flapper will momentarily move downward and then immediately move upward.

The operation of the eccentric cam 35 is controlled by the cam drive unit, and is made to rotate one or multiple times for each operation. The cam drive unit normally controls the flapper 33 to be in the lower condition when paper has been put in place as shown in FIG. 5(*a*), and when printer data is received, controls the flapper to lift to push on the paper feeder roller 23 through the paper, and to lower when feeding of the paper by the paper feeder roller 23 is complete.

Figure 5A:
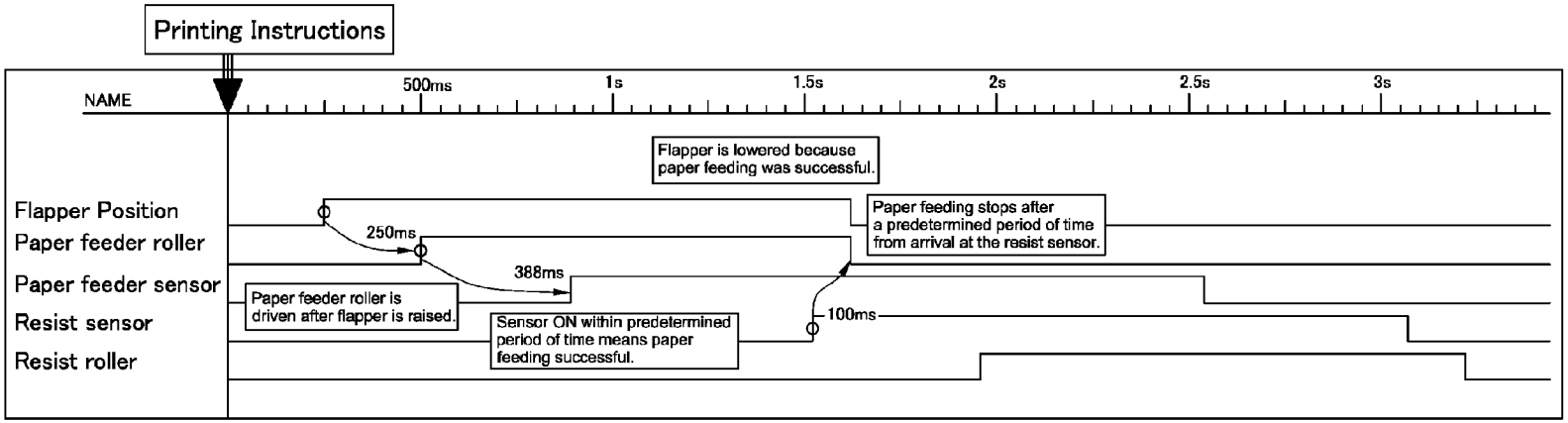
FIG. 5 is a timing chart.
Figure 5B:
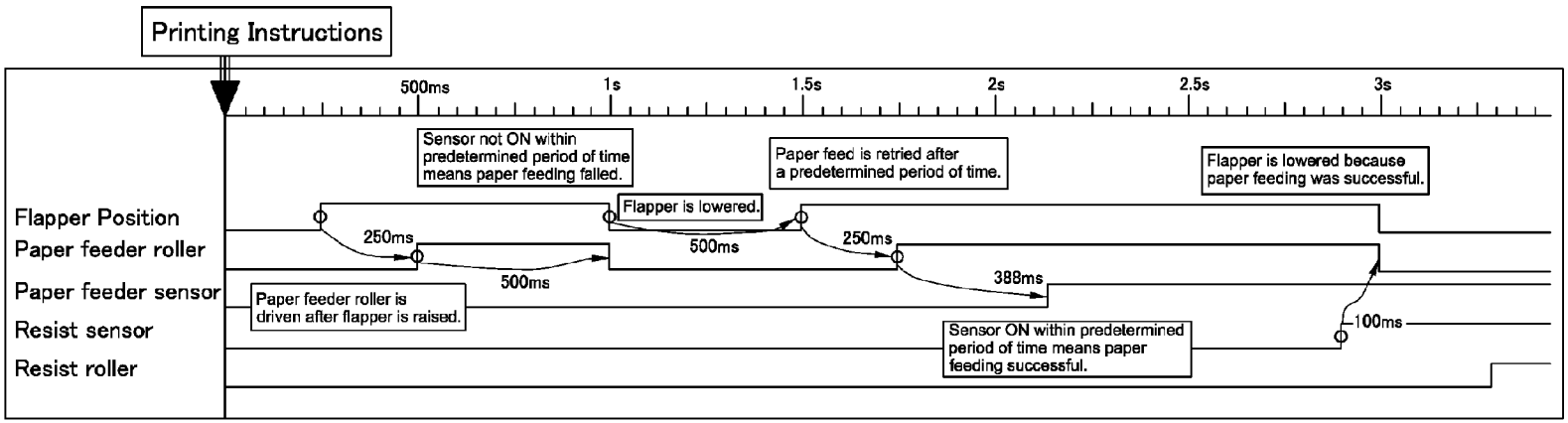

On the other hand, the cam drive unit controls the eccentric cam 35 to move up and down prior to the retry control as shown in FIG. 5(*b*) when paper is not detected by the paper feeder sensor 29 even though paper feeding by the paper feeder roller 23 has started.

Incidentally, FIG. 5 is a timing chart showing the movement over time (units: second/s) of each unit after printing instructions have been received (print data has been received), and the time "ms" shown in the figure shows the time required from the starting point of the curved arrows to the ending point.

The communication unit (instructing unit) 26 is for sending and receiving image data or the like between personal computers (hereinafter referred to as PC) or the like, and when image data is received, provides instructions to the flapper drive unit 25 and the roller drive unit 31 in order to feed paper.

The control panel 27 has a plurality of operating keys not shown in the figure and a display (notifying means). The operating keys include keys for setting the output conditions of the print data or the like. The display displays various information relating to output of the print data and a message that a paper jam has occurred if transport of paper is not detected by the paper feeder sensor 29 even though retry control has been performed a predetermined number of times.

The paper feeder sensor 29 is placed above the transport route 37 provided inside the main body of the printer 1, and turns from the OFF condition to the ON condition when paper moving through the transport route 37 is detected.

The roller drive unit 31 rotationally drives the paper feeder roller 23 and performs retry control such as momentarily stopping rotation or changing the rotational speed or the like of the paper feeder roller 23 if paper is not detected by the paper feeder sensor 29 within a predetermined period of time after beginning to rotationally drive the paper feeder roller.

Operation of Image Forming Device

Figure 6:
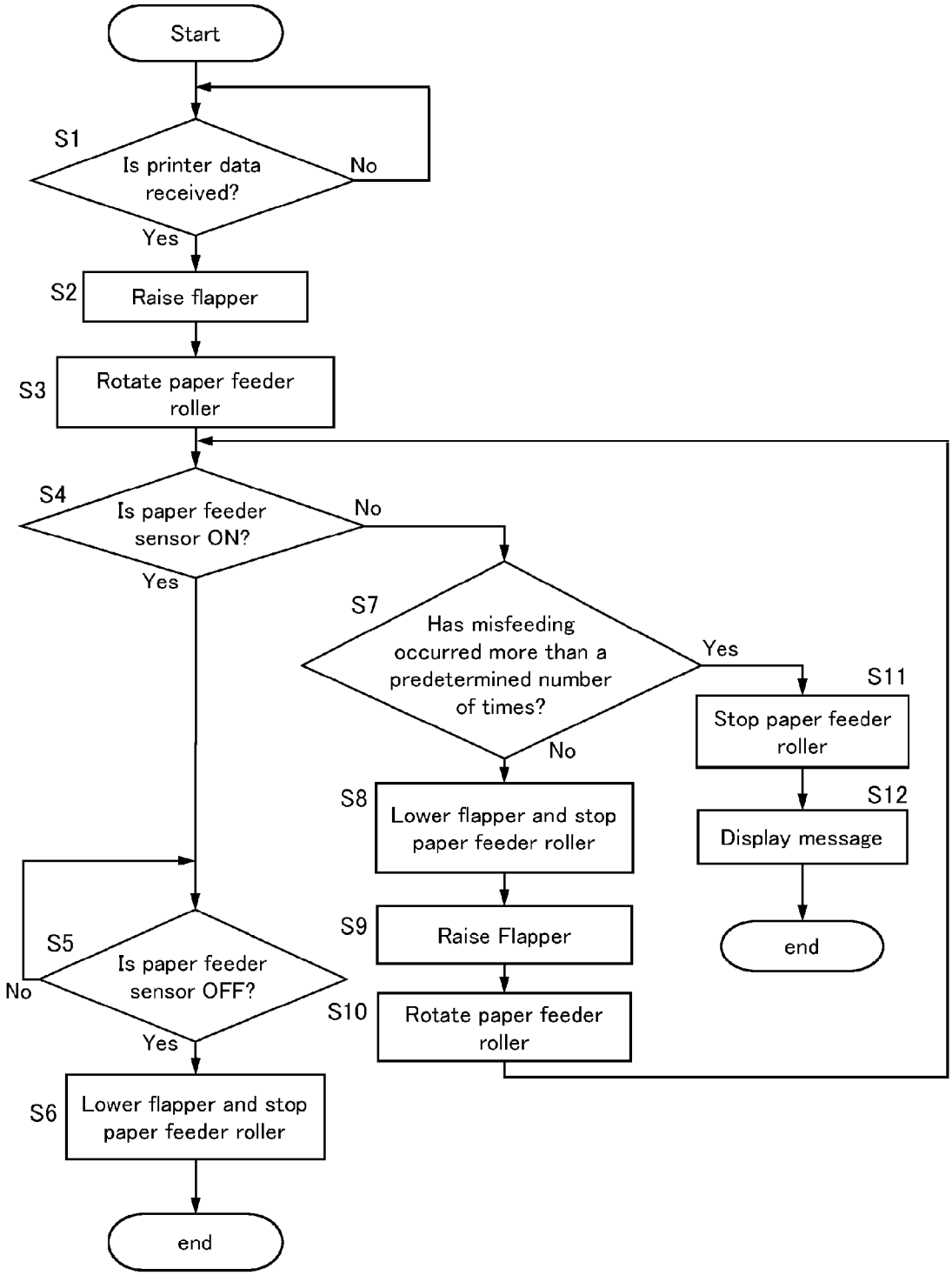
FIG. 6 is a flowchart for describing the operation of the image forming device.

Next, the operation of the printer 1 will be described based on FIG. 6.

When using this printer 1, first paper is set on the manual feed tray 21. In this condition, when print data is received from the PC or the like (S1), the flapper 33 will rise and will push on the paper feeder roller 23 through the paper from the bottom (S2). Next, the paper feeder roller 23 will rotate and begin to feed the paper (S3).

Furthermore, if the paper sensor is turned ON within a predetermined period of time from the moment the paper feeder roller 23 is driven (S4), the paper feeding will be determined to be successful, the paper feeder sensor 29 will turn OFF and wait for the completion of paper feeding (S5), the flapper 33 will move downward, and the paper feeder roller 23 will stop rotating (S6).

On the other hand, if the paper feeder sensor 29 is not turned ON within a predetermined period of time after driving the paper feeder roller 23 (S4), the paper feeding will be determined to have failed, the flapper 33 will move downward, and the paper feeder roller 23 will stop rotating (S8). After momentarily moving downward, the flapper 33 will promptly rise again (S9), and then the paper feeder roller 23 will again begin rotating (S10).

Furthermore, after step S10 is complete, the process will return to step S4, and if the paper feeder sensor 29 is turned ON, the paper feeding will be determined to be successful and then the procedures of step S5 and step S6 will be performed. On the other hand, if the paper feeder sensor 29 is not turned ON within the predetermined period of time and the paper feeding fails, the procedures of steps S8 through S10 will again be performed until misfeeding has been detected more than a predetermined number of times.

On the other hand, in step S7, if it is determined that misfeeding has occurred more than a predetermined number of times, a paper jam will be determined to have occurred, the paper feeder roller 23 will stop rotating (S11), and the user will be notified by displaying a message to that effect on the display (S12).

With a printer 1 having the above construction, when retry control is performed after a misfeeding has been detected, the flapper 33 will move up and down before paper is fed so that the paper on the flapper 33 will move smoothly, and therefore the paper feeding performance will be improved and the occurrence of paper jams can be reduced.

Other Embodiments (a) The timing for moving the flapper up and down is not restricted to prior to retry control, and may also be performed beforehand prior to receiving print data so long as the paper has been set in place, or may be continuously performed after print data has been received, or may be performed as a combination thereof.

(b) With the above embodiment, the control of the paper feeder including retry control may be performed by the control unit 7.

(c) The paper feeder of the present invention is not restricted to manual feed trays, and can also be applied to paper feeder cassettes.

(d) When a paper jam occurs, predetermined sound information may also be sent from speakers separately established on the image forming device.

(e) The present invention can be applied to not only color printers, but monochrome printers as well, and may also be applied to other image forming devices such as copiers, fax machines, or combination machines thereof. In particular, for image forming devices which have copier functions, the present invention can also be applied to the parts relating to the document feeder in an ADF, if an ADF is provided.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. The entire disclosure of Japanese Patent Application No. is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A paper feeder for an image forming device, comprising:

a paper placing unit having a flapper being configured to contact paper from the bottom and to move up and down in the paper stacking direction;

a paper feeder roller positioned above the paper placing unit being configured to feed paper on the flapper;

a flapper drive unit being configured to move the flapper up and down in the paper stacking direction, and the flapper drive unit moving the flapper up at least from the moment that paper is placed on the paper placing unit until paper is fed by the paper feeder roller; and a detector being located downstream from the paper placing unit and configured to detect paper fed from the paper placing unit, the detector detecting whether paper is supplied after the flapper has been moved up and while the flapper is in an up position, and a controller controlling the flapper drive unit to lower the flapper from the up position in accordance with the detector detecting that paper has not been supplied after the flapper has been moved up, and the flapper drive unit subsequently and immediately raising the flapper again after lowering the flapper.

2. The paper feeder for an image forming device according to claim 1, further comprising an instructing unit that provides instructions for paper to be fed by the paper feeder roller.

3. The paper feeder for an image forming device according to claim 1, further comprising a roller drive unit that rotationally drives the paper feeder roller and sends a retry control to the paper feeder roller when paper is not detected by the detector in a predetermined period of time after instructions to feed paper.

4. The paper feeder for an image forming device according to claim 3, further comprising a notifying device that notifies that a paper jam has occurred when the paper is not detected by the detector even though retry control by the roller drive unit has been performed a predetermined number of times.

5. An image forming device, comprising:

the paper feeder for an image forming device according to claim 1; and an image forming unit which forms an image on paper fed from the paper feeder.

6. A storage medium for a paper feeder control program executed by a paper feeder which comprises a paper placing unit with a flapper configured to contact paper from the bottom and configured to move up and down in the paper stacking direction, a paper feeder roller positioned above the paper placing unit configured to feed paper onto the flapper, and a flapper drive unit configured move the flapper up and down in the paper stacking direction;

the paper feeder control program storage program comprising one or more software elements which perform the steps of:

moving the flapper up using the flapper drive unit in a paper placing unit where paper has been placed; and feeding paper by of the paper feeder roller after moving the flapper up;

detecting by a detector paper fed from paper placing unit by the paper feeding roller after moving the flapper up and while the flapper is in an up position;

lowering the flapper from the up position if the detector detects that paper has not been supplied after moving the flapper up; and raising the flapper immediately again after lowering the flapper.

7. A control method for a paper feeder which comprises a paper placing unit with a flapper configured to contact paper from the bottom and configured to move up and down in the paper stacking direction, a paper feeder roller positioned above the paper placing unit configured to feed paper onto the flapper, and a flapper drive unit configured to move the flapper up and down in the paper stacking direction, comprising the steps of:

moving the flapper up by a flapper drive unit in the paper placing unit onto which paper has been placed;

feeding paper by the paper feeder roller after moving the flapper up;

detecting by a detector paper fed from paper placing unit by the paper feeding roller after moving the flapper up and while the flapper is in an up position;

lowering the flapper from the up position if the detector detects that paper has not been supplied after moving the flapper up; and raising the flapper immediately again after lowering the flapper.

8. The paper feeder for an image forming device according to claim 3, wherein when the detector detects that paper has not been supplied after the flapper has been lowered and raised in response to the detector previously detecting that paper has not been supplied and after the roller drive unit has sent the retry control to the paper feeder roller the flapper drive unit again lowers and subsequently and immediately raises the flapper.

9. The control method according to claim 7, further comprising lowering and raising the flapper immediately again after lowering the flapper a predetermined number of times or until the detector detects paper.

* * * * *